US005933912A

United States Patent [19]

Karr et al.

[11] Patent Number: 5,933,912

[45] Date of Patent: Aug. 10, 1999

[54] WET EXTRACTOR SYSTEM

[75] Inventors: Richard Karr, Wapella; David Erickson; Kevin Genge, both of Normal; William Hanold, Bloomington; Gregory Luebbering, Heyworth; William Phelan, Normal, all of Ill.

[73] Assignee: White Consolidated Industries, Inc., Cleveland, Ohio

[21] Appl. No.: 08/925,892

[22] Filed: Sep. 8, 1997

Related U.S. Application Data

[62] Division of application No. 08/588,436, Jan. 18, 1996, Pat. No. 5,784,755.

[51] Int. Cl.[6] ..... A47L 7/00

[52] U.S. Cl. ..... 15/320; 15/328; 15/322; 15/331; 15/334

[58] Field of Search ..... 15/320, 322, 328, 15/331, 334, 387

[56] References Cited

U.S. PATENT DOCUMENTS

| | | | |
|---|---|---|---|
| 3,983,592 | 10/1976 | Fegan | 15/49 R |
| 4,114,231 | 9/1978 | Nauta | 15/413 |
| 4,200,951 | 5/1980 | Burgoon et al. | 15/321 |
| 4,575,007 | 3/1986 | Groth et al. | 239/310 |
| 4,676,287 | 6/1987 | Fitzwater | 141/285 |
| 5,311,638 | 5/1994 | Fureron et al. | 15/321 |
| 5,493,752 | 2/1996 | Crouser et al. | 15/321 |
| 5,669,098 | 9/1997 | Tono | 15/321 |

FOREIGN PATENT DOCUMENTS

| | | | |
|---|---|---|---|
| 2072496 | 3/1980 | United Kingdom | A47L 7/00 |

*Primary Examiner*—David A. Redding

*Attorney, Agent, or Firm*—Pearne, Gordon, McCoy & Granger LLP

[57] ABSTRACT

An upright wet extractor includes a base assembly, a manipulative handle pivotally attached to the base assembly, and a motor driven agitator brush. A cleaning solution dispensing tank is removably attached to the handle assembly by a pivotable latch member. In a floor cleaning mode, cleaning solution is selectively supplied by gravity from the dispensing tank to a floor cleaning spray nozzle through a supply tube which is controlled by a pinch valve. In an attachment hose cleaning mode, cleaning solution is selectively supplied by a motor driven pump from the dispensing tank to an attachment hose spray nozzle which is controlled by a trigger valve. A suction motor/fan assembly is carried by the base assembly which is selectively in fluid communication with a floor suction nozzle in the floor cleaning mode and an attachment hose suction nozzle when in the attachment hose cleaning mode. Conversion between the floor cleaning mode and the attachment hose cleaning mode is conveniently carried out by manual operation of a knob of multi-functional valve/switch assembly. The valve/switch assembly includes a valve member which diverts the flow of working air and a micro-switch which appropriately activates and deactivates the agitator brush motor and the pump motor. A recovery tank assembly which both separates liquid from air and stores the recovered liquid is removably secured within the base assembly below the suction pump and can be removed through the rear end of the base assembly. The suction motor/fan assembly includes a cooling fan which draws cooling air over both the pump motor and the motor of the suction motor/fan assembly.

39 Claims, 12 Drawing Sheets

20
26
36
42
44
32
92
220
220
164
24
28
40
140
142
144
30
34
38
154
170
172
22

32
34
234
320
368
370
372
374
376
378
380
382
384
386
388
390
392
394
396
398
400
402
404
406
408
410
412
414
416
418
232
236
238
240
242
244
246
248
250
254
256
258
260
262
264
266
270
272
274
276
278
280
282
284
286

Fig.11a
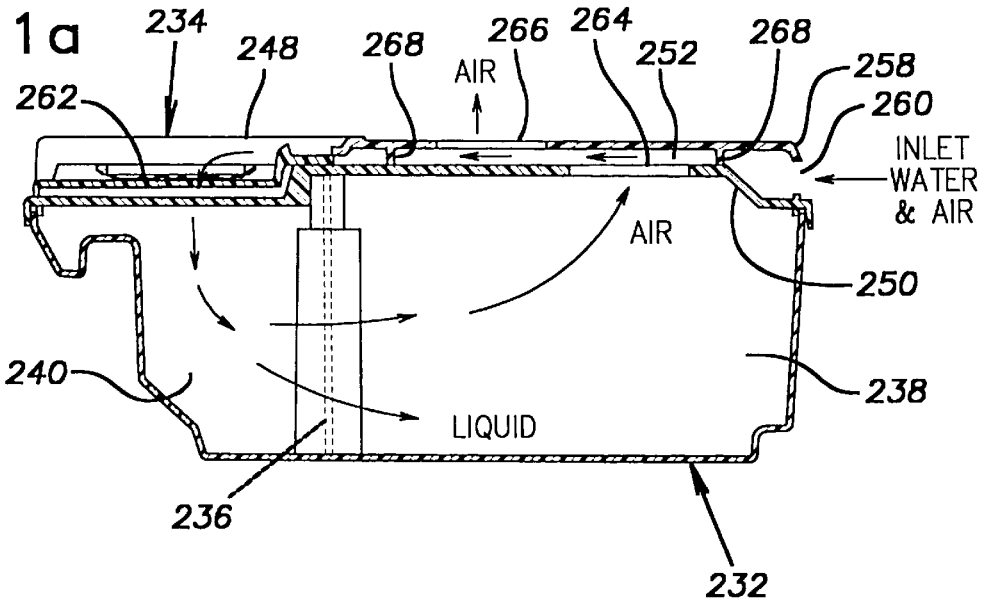
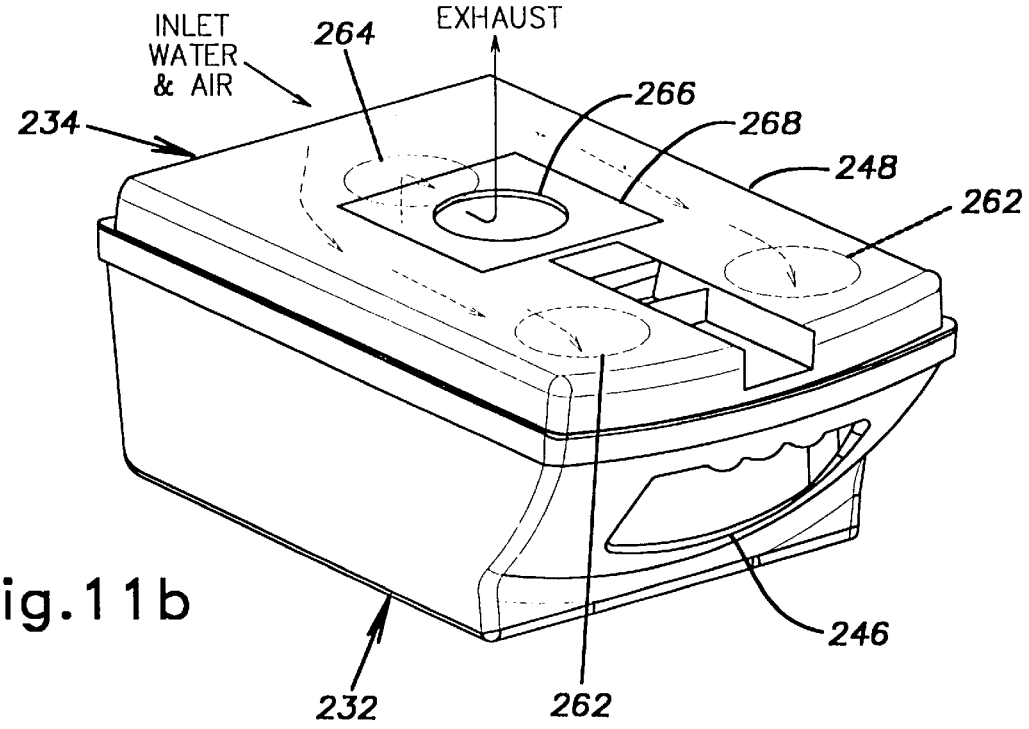
Fig.11b

WET EXTRACTOR SYSTEM

This is a divisional of application Ser. No. 08/588,436, filed Jan. 18, 1996 now U.S. Pat. No. 5,784,755.

BACKGROUND OF THE INVENTION

The present invention relates to an improved upright wet extractor, and more specifically, to an upright extractor having an onboard attachment hose assembly.

SUMMARY OF THE INVENTION

The present invention provides an improved wet extractor which can be conveniently converted between a floor cleaning mode and an attachment cleaning mode. The wet extractor includes a main body, a suction fan attached to the main body which has an inlet. The wet extractor also includes a floor suction nozzle, an above-floor suction nozzle, a cleaning solution dispensing tank having an outlet, a cleaning solution spray nozzle having an inlet, a cleaning solution pump having an inlet in fluid communication with the outlet of the cleaning solution dispensing tank and an outlet in fluid communication with the inlet of the cleaning solution spray nozzle, and preferably a pump motor operatively connected to the cleaning solution pump for driving the cleaning solution pump. Preferably, a floor cleaning agitator brush and an agitator brush motor are provided. A converter assembly has an outlet in fluid communication with the inlet of the suction fan, a first inlet in fluid communication with the floor suction nozzle, a second inlet in fluid communication with the above-floor suction nozzle, a movable valve member adapted to block the second inlet in a first position and to block the first inlet in a second position, an external knob attached to the valve member for selectively moving the valve member between the first position and the second position, and a switch electrically responsive to the position of the knob to preferably de-energize the pump motor and energize the agitator brush motor when the knob is in the first position and to energize the pump motor and de-energize the agitator brush motor when the knob is in the second position. Conversion between the floor cleaning mode and the attachment hose cleaning mode is conveniently carried out by manual operation of a knob of the convertor assembly.

In a preferred embodiment of the present invention, a cleaning solution dispensing tank is removably attached to a manipulative handle by a pivotable latch member. The manipulative handle is pivotally attached to the base member. In the floor cleaning mode, cleaning solution is preferably selectively supplied by gravity from the dispensing tank to a floor cleaning spray nozzle through a supply tube which is controlled by a pinch valve. In the attachment hose cleaning mode, cleaning solution is selectively supplied by the motor driven pump from the dispensing tank to an attachment hose spray nozzle which is controlled by a trigger valve. According to another preferred embodiment of the present invention a recovery tank assembly which both separates liquid from air and stores the recovered liquid is removably secured within the main body below the suction pump and can be removed through the rear end of the main body. According to yet another preferred embodiment of the present invention, the suction fan includes a cooling fan which draws cooling air over both the pump motor and the motor of the suction fan.

BRIEF DESCRIPTION OF THE DRAWINGS

These and further features of the present invention will be apparent with reference to the following description and drawings, wherein:

FIG. 11*a* is an elevational view, in cross-section, of the recovery tank assembly of FIG. 7 illustrating flow paths of water and air;

FIG. 11*b* is a perspective view of the recovery tank assembly of FIG. 7 illustrating the flow paths of water and air;

DETAILED DESCRIPTION OF THE PREFERRED EMBODIMENT

Figure 1:
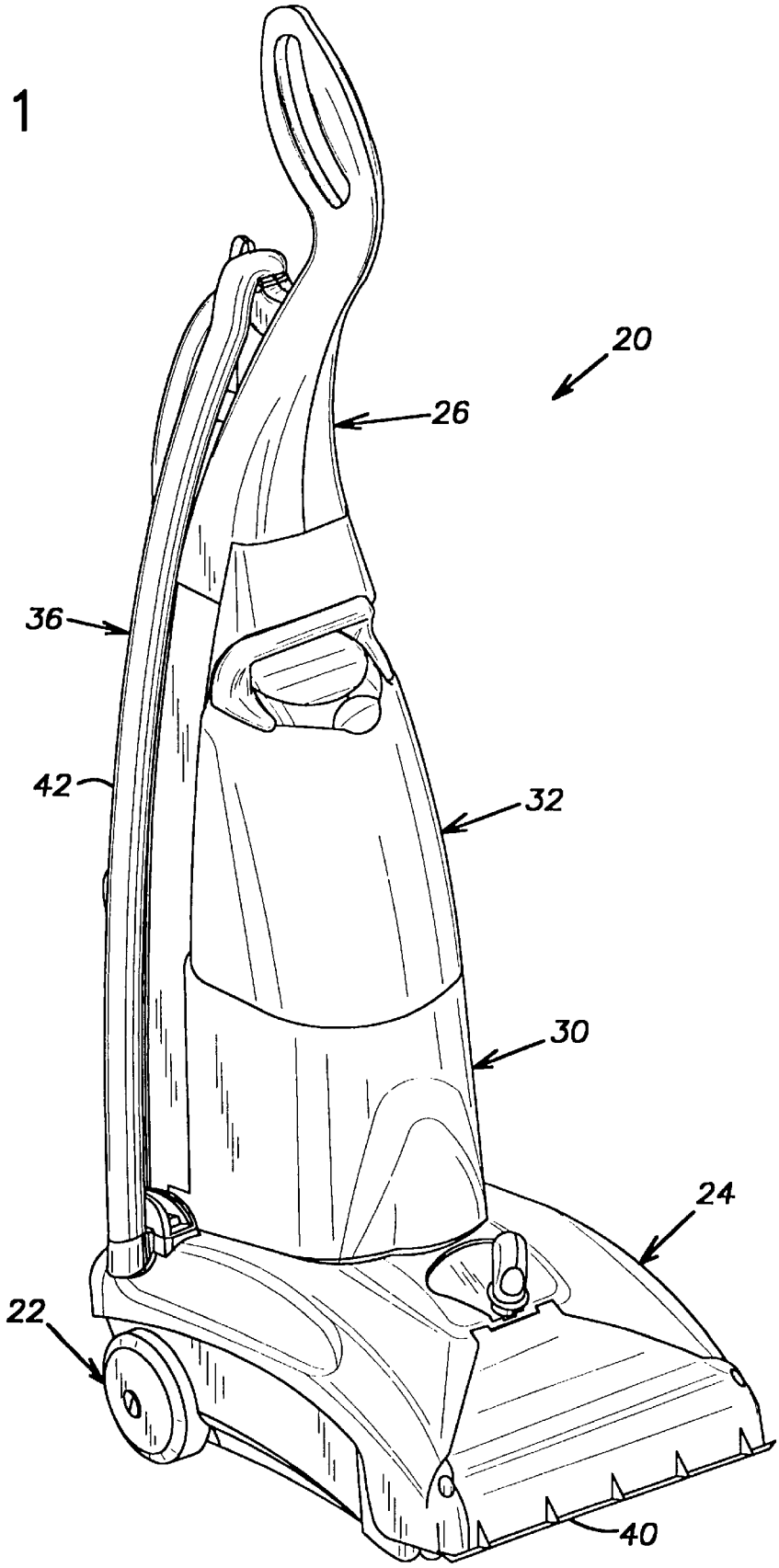
FIG. 1 is a perspective view of a wet extractor according to the present invention.
Figure 2:
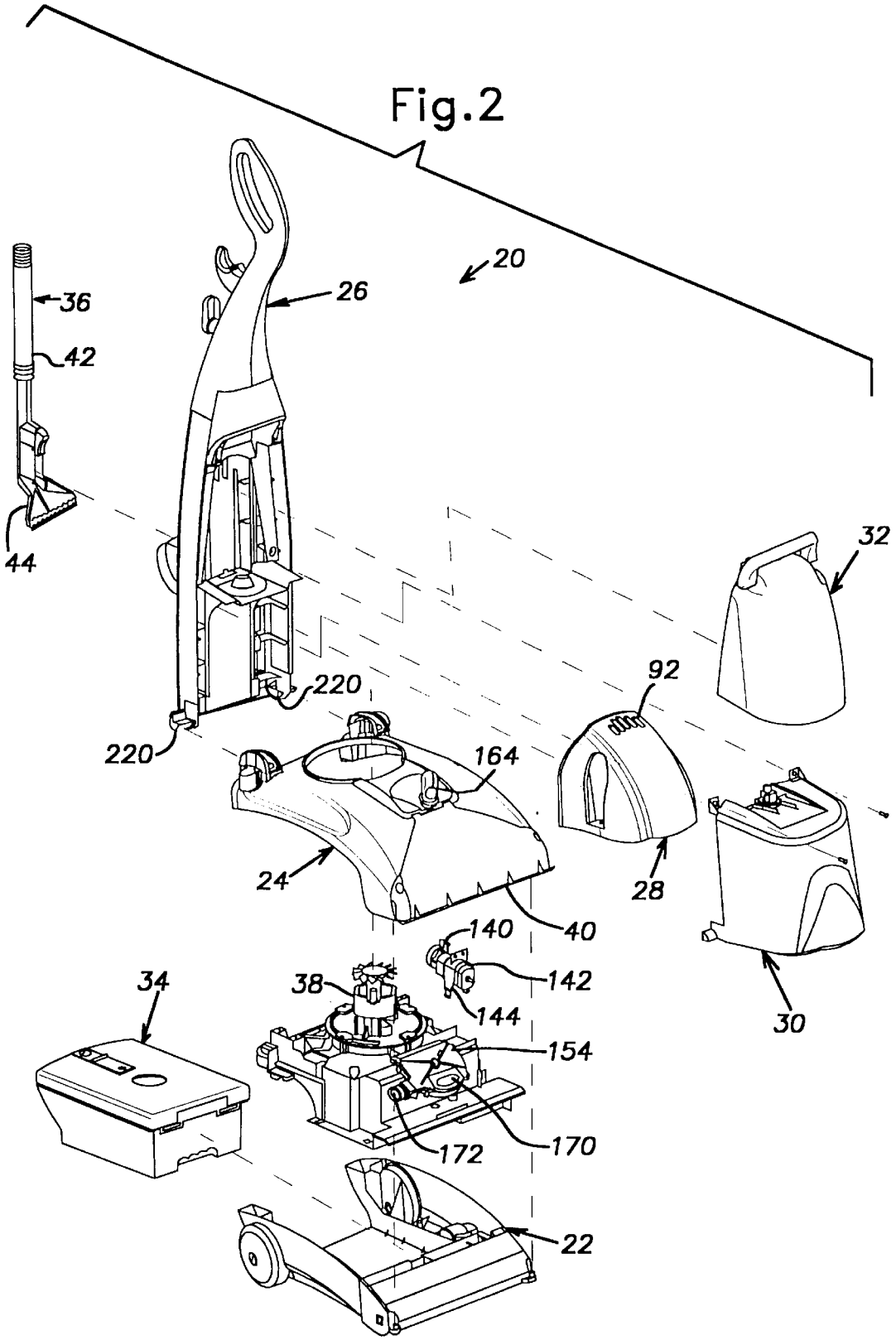
FIG. 2 is an exploded view showing the principle components and subassemblies of the wet extractor of FIG. 1.

FIGS. 1 and 2 illustrate an upright wet extractor 20 according to the present invention. The wet extractor 20 includes a base assembly 22, a hood assembly 24, a handle assembly 26, a motor cover 28, a shroud 30, a dispensing tank assembly 32, a recovery tank assembly 34, and an attachment hose assembly 36. The base assembly 22 (best shown in FIG. 3) carries a motor/fan assembly 38 along with all of the other components. The hood assembly 24 (best shown in FIG. 4) is attached over the base assembly 22 and includes a floor suction nozzle 40 at a forward end thereof. The handle assembly 26 (best shown in FIG. 5) is pivotally attached to the rear end of the base assembly 22. The motor cover 28 is attached to the base assembly 22 and surrounds, in cooperation with the handle assembly 26, the motor/fan assembly 38. The shroud 30 is attached to the handle assembly 26 and surrounds, in cooperation with the handle assembly 26, the motor cover 28 to give a generally smooth integrated appearance with the dispensing tank assembly 32. The dispensing tank assembly 32 (best shown in FIG. 6) is releasably secured to the handle assembly 26 above the shroud 30. The recovery tank assembly 34 (best shown in FIG. 7) is releasably secured within the base assembly 22. The onboard attachment hose assembly 36 (best shown in FIG. 8) includes a corrugated suction hose 42 which is stored on the handle assembly 26. One end of the suction hose 42 is attached to a nozzle assembly 44 and the other end of the suction hose 42 passes through an opening in the rearward end of the hood assembly 24.

Figure 3:
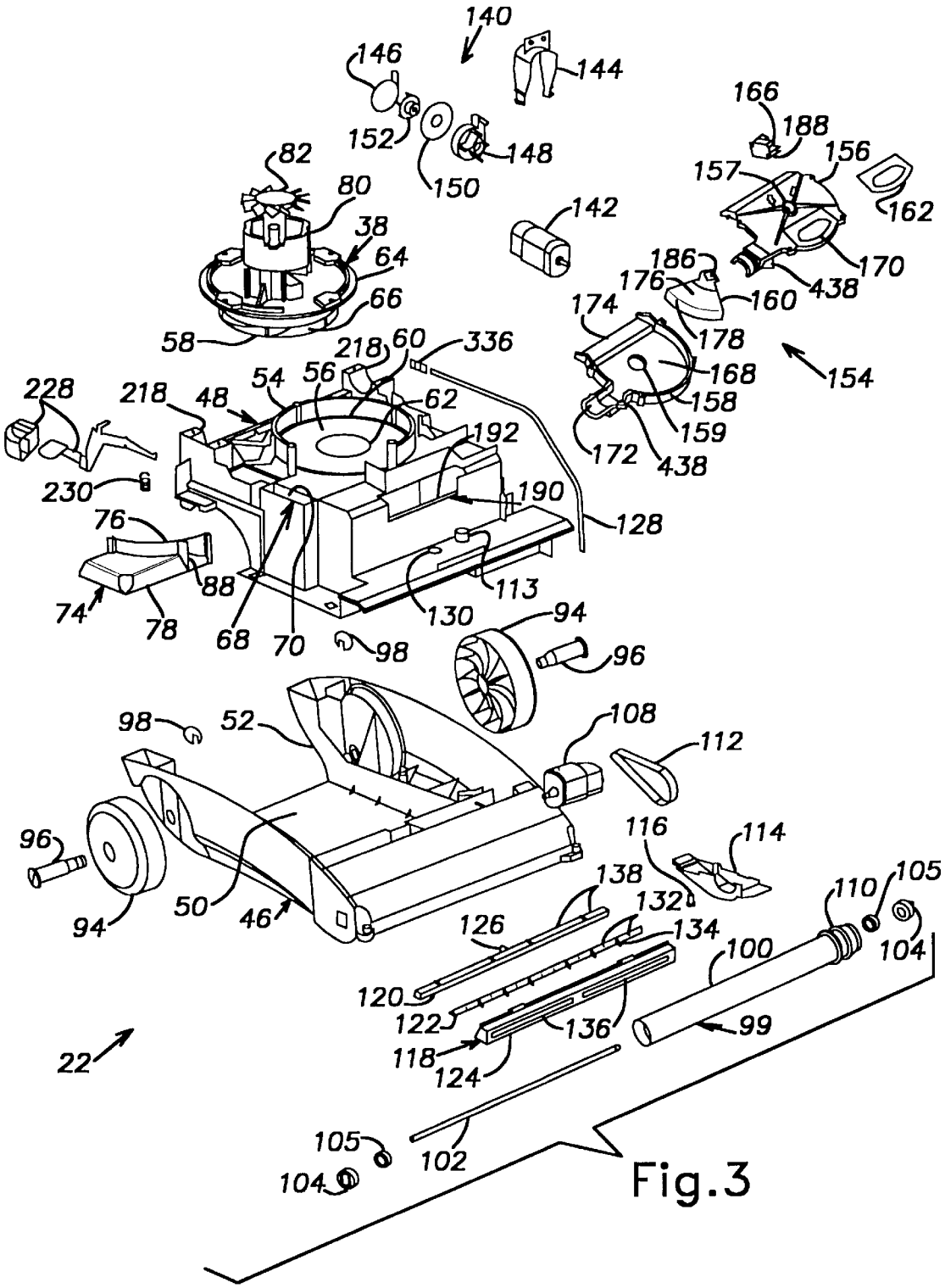
FIG. 3 is an exploded view of a base assembly of FIG. 2.

As best shown in FIG. 3, the base assembly 22 includes a molded base frame 46 and a separate molded motor support 48 which is attached to the top of the base frame 46. Formed between the base frame 46 and the motor support 48 is a cavity 50 having a rearward facing opening 52. The cavity 50 and opening 52 are sized and shaped for receiving the recovery tank assembly 34.

Integrally molded into the bottom of the motor support 48 is a wall 54 which partially forms a circular-shaped stepped basin 56 which receives a suction-fan portion 58 of the motor/fan assembly 38. A bottom surface of the suction-fan portion 58 sealingly engages a ledge 60 near the bottom of the basin 56 to form an inlet air plenum chamber between the bottom of the suction-fan portion 58 and the bottom of the basin 56. The plenum chamber provides fluid communication between an inlet air opening 62 which is centrally located at the bottom of the basin 56 and the inlet of the suction-fan portion 58 which is located on the bottom of the suction-fan portion 58.

Figure 9:
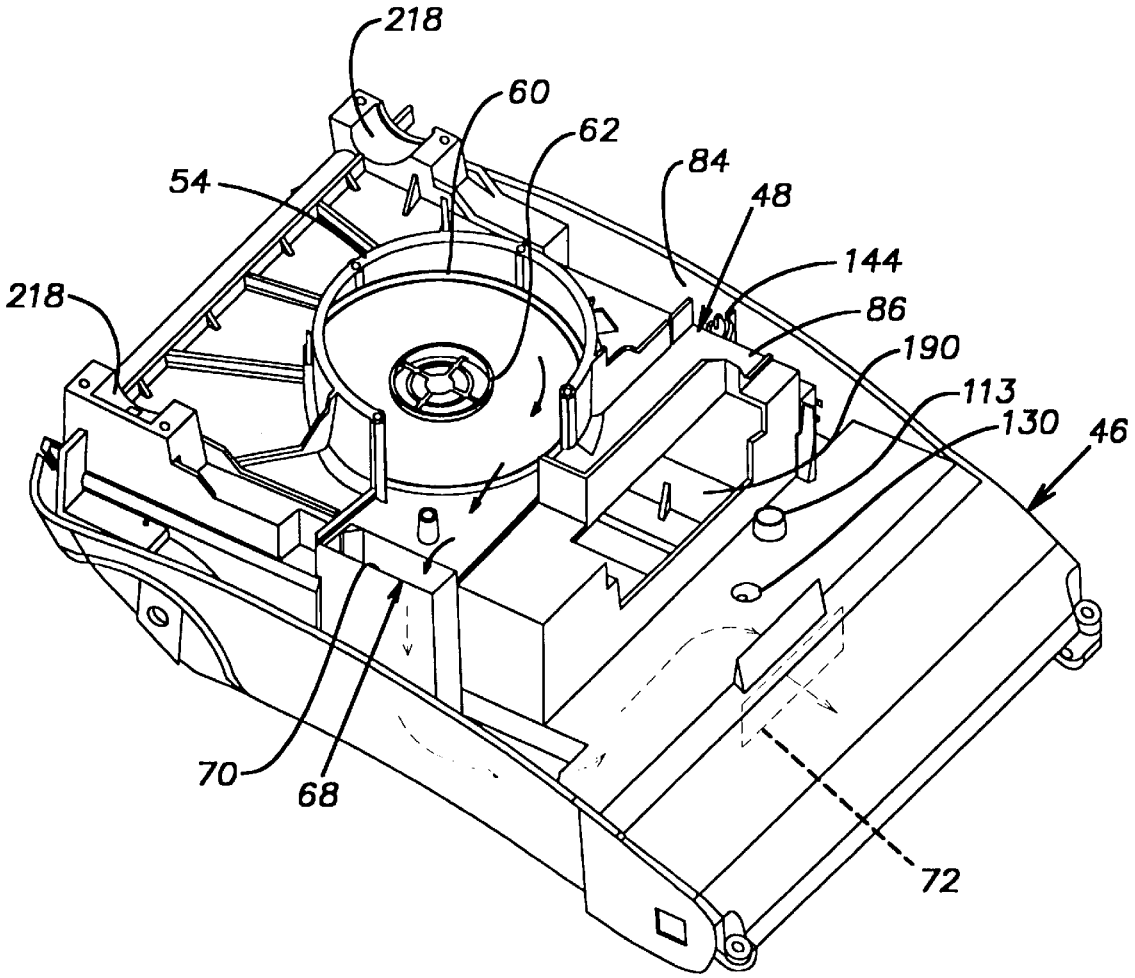
FIG. 9 is a perspective view of some components of the base assembly of FIG. 3 illustrating a flow path of exhaust air.

A mounting flange 64 of the motor/fan assembly 38 is attached to a top edge of the wall 54 and cooperates with the wall 54 to form an exhaust air plenum chamber circumscribing the exit air ports 66 of the suction-fan portion 58. Integrally molded in the base frame 46 and motor support 48 is an exhaust air duct 68 which has a rectangularly-shaped and upward facing inlet 70 located along the right side of the motor support 48 at the top of the base assembly 22. The exhaust air duct 68 also has a rectangularly-shaped and forward facing outlet 72 (FIG. 9) located along the forward end of the base frame 46 at the bottom of the base assembly 22. A connecting member 74 cooperates with the motor support 48 to provide a passage for fluid communication between the exhaust air plenum chamber and the exhaust air duct 68. The connecting member 74 has a wall portion 76 which cooperates with the wall 54 of the motor support 48 to form the exhaust air plenum chamber and an exhaust duct portion 78 which connects the exhaust air plenum chamber and the inlet 70 of the exhaust air duct 68. As best shown in FIG. 9, the exhaust air flows (indicated by arrows) from the exhaust air plenum chamber, through the connecting member 74, downwardly into the inlet 70 of the exhaust air duct 68, through the exhaust air duct 68, and forwardly out the outlet 72 of the exhaust air duct 68.

Figure 10:
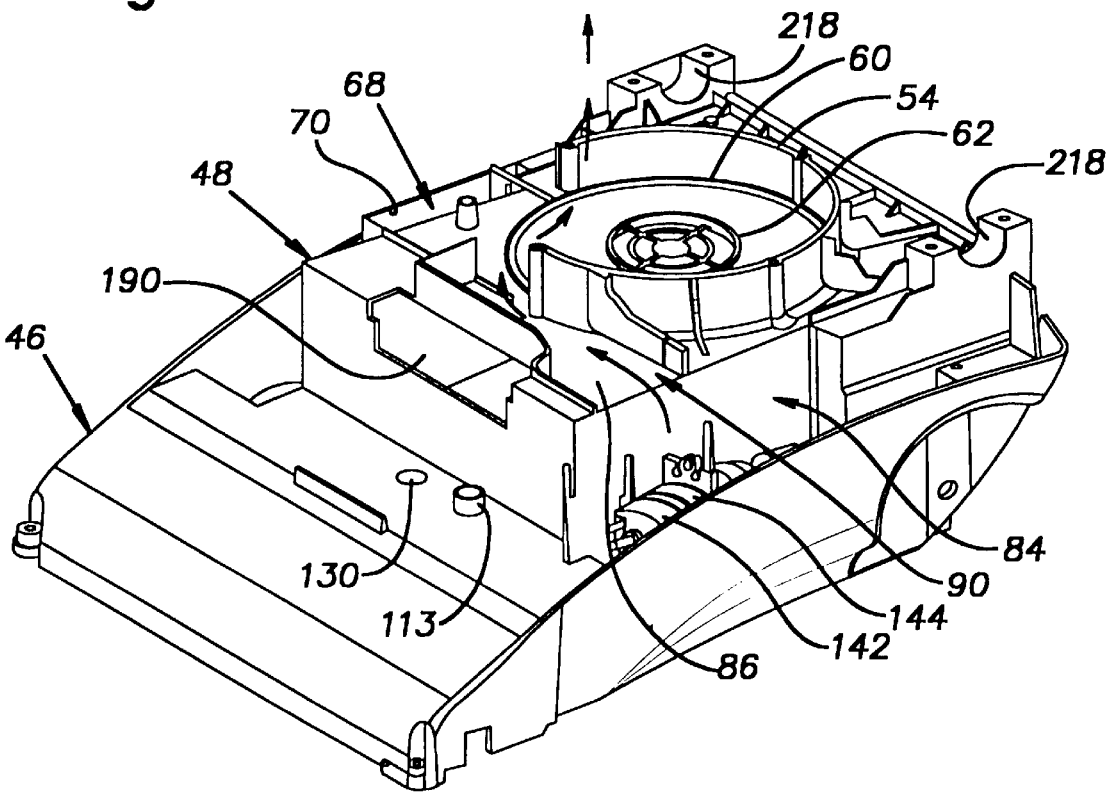
FIG. 10 is a perspective view of some components of the base assembly of FIG. 3 illustrating a flow path of cooling air.

As best shown in FIGS. 2 and 3, the motor cover 28 surrounds both a motor portion 80 and a cooling-fan portion 82 of the motor/fan assembly 38 and defines a cooling air chamber therein. As best shown in FIG. 10, integrally formed in the top of the motor support 48 is a first channel 84 which longitudinally extends along the left side of the base assembly 22 and a second channel 86 which transversely extends from the forward end of the first channel 84 to the connecting member 74. The connecting member 74 has a cooling air duct portion 88 which closes the end of the second channel 86 and provides fluid communication between the second channel 84 and the cooling air chamber. The hood assembly 24 cooperates with the first and second channels 84, 86 formed in the motor support 48 to form a cooling air duct or conduit 90 to the cooling air chamber. As best shown in FIG. 10, cooling air (indicated by arrows) is drawn by the cooling fan portion 82 through a suitable inlet of the first channel 84, through the first channel 84, into to the second channel 86, through the second channel 86 to the cooling air duct portion 88 of the connecting member 74, over the connecting member 74 into the bottom of the cooling air chamber, upward through the cooling air chamber over the motor portion 80, and exhausted out of the cooling air chamber through a cooling air outlet 92 located at the top of the motor cover 28. As shown in FIG. 2, the cooling air outlet 92 of the illustrated embodiment is a plurality of slots located at the top of the motor cover 28.

Suitably attached to the rear of the base frame 46 are a pair of laterally displaced wheels 94. The wheels 94 are each mounted for rotation with an axle member 96 and retainer 98. Suitably attached to the front of the base frame 46 is an agitator brush assembly 99. The agitator brush assembly 99 includes a cylindrical-shaped distributor or brush roll 100 having a horizontal and lateral extending axis of rotation. The brush roll 100 is preferably mounted for rotation with a shaft member 102, retainers or end caps 104, and bearings 105 in a known manner. The brush roll 100 is driven by an electric motor 108 attached to the base frame 46 and connected to a drive end 110 of the brush roll 100 with a drive belt 112. An opening 113 is provided at the forward end of the motor support 48 for passage of wires into the base frame 46 to the electric motor 108 therebelow. The drive end 110 of the brush roll 100 and the drive belt 112 is enclosed by a belt cover 114 attached to the bottom of the base frame 46. The belt cover 114 is attached with a single screw 116 for easy replacement of the drive belt 112.

Attached to the bottom of the base frame 46 behind the brush roll 100 is a floor cleaning solution spray nozzle or discharge nozzle assembly 118. The discharge nozzle assembly 118 includes a liquid manifold 120, a cover plate 122, and an outer housing 124. The liquid manifold 120 forms a generally elongate and horizontally extending cavity which is open at a forward facing side. Integrally molded with the liquid manifold 120 is cleaning solution inlet 126 to provide fluid communication between a supply tube 128 and the interior cavity of the liquid manifold 120. A centrally located opening 130 is provided at the forward end of the motor support 48 for passage of the supply tube 128 into the base frame 46 to the cleaning solution inlet 126 of the discharge nozzle assembly 118. The cover plate 122 closes the open forward facing side of the liquid manifold 120 and includes a plurality of laterally spaced orifices 132. Preferably a flow dam 134 is positioned between each of the orifices 132 to prevent liquid cleaning solution, exiting the orifices 132, from adhering to and flowing laterally along the front face of the cover plate 122.

The outer housing 124 of the discharge nozzle assembly 118 forms a generally elongate and horizontally extending cavity which is open at a rearward facing side and has a pair of forward facing discharge openings 136. The liquid manifold 120 and cover plate 122 are positioned within the cavity of the outer housing 124 with the orifices 132 facing the discharge openings 136. The liquid manifold 120 includes ribs 138 on its outer periphery to position the liquid manifold 120 within the outer housing 124 with a gap between the liquid manifold 120 and the outer housing 124 to permit the flow of exhaust air therebetween. The outer housing 120 is attached to the base frame 46 over the exhaust outlet 72 whereby exhaust air from the suction-fan portion 58 of the fan/motor assembly 36 exiting through the exhaust outlet 72 in the base frame 46 enters the outer housing 124, flows over the liquid manifold 120, and exits the discharge nozzle assembly 118 through discharge openings 136.

Liquid cleaning solution flows, by gravity, through the supply tube 128 into the cavity of the liquid manifold 120 through the cleaning solution inlet 126, through the orifices 132 of the cover plate 122 into turbulent airflow created by the converging airflows of the exhaust air flowing over the liquid manifold 120, and exits the discharge nozzle assembly with the exhaust air through the discharge openings 136.

An attachment hose cleaning solution pump 140 and an associated electric motor 142 are secured in the first channel 84 by a bracket 144. The pump 140 includes first and second housing members 146, 148, a gasket 150, and a rotatably mounted impeller 152 as is conventional manner. The pump 140 supplies cleaning solution to the attachment hose assembly 36 as further described below. As best shown in FIG. 10, cooling air flowing through the cooling air duct 90 flows over the pump motor 142 to cool the pump motor 142 as well as the motor portion 80 of the motor/fan assembly 38.

As best shown in FIG. 2, a multi-functional converter switch or valve/switch assembly 154 is attached to the forward end of the motor support 48 which is manually operated to selectively divert suction flow of the working air between the floor cleaning suction nozzle 40 and the attachment hose nozzle assembly 44. The valve/switch assembly 154 also controls the motor 108 of the agitator brush assembly and the motor 142 of the attachment cleaning solution pump 140. As best shown in FIG. 3, the valve/switch assembly 154 includes upper and lower body halves 156, 158, a valve member 160, a gasket 162, a knob 164 (FIG. 4), and a micro-switch 166. The upper and lower body halves 156, 158 are attached together and cooperate to form a generally cylindrically-shaped interior chamber 168, first and second inlets 170, 172 to the chamber 168, and an outlet 174 from the chamber 168. The first inlet 170 is generally elongate and formed in the upper wall at a forward end of the upper body halve 156. The gasket 162 is provided about the first inlet 170 on the upper surface of the upper wall of the upper body halve 156. The second inlet 172 is circular and cooperatively formed at the left side of each of the upper and lower body halves 156, 158. The second inlet 172 is adapted for receiving the end of the suction hose 42 of the attachment hose assembly 36. The outlet 174 is a generally elongate slot cooperatively formed at the rear end of each of the upper and lower body halves 156, 158. The valve member 160 is sized and shaped to selectively close one of the first and second inlets 170, 172. The illustrated valve member 160 is generally wedge-shaped having a top surface 176 sized to close the first inlet 170 and a circumferential surface 178 sized to close the second inlet 172. The knob 164 (FIG. 4) includes a pin 180, a cam 182, and a grasping handle 184 which extends perpendicular to the pin 180. The valve member 160 has an opening 186 adapted to receive the pin 180 to attach the valve member 160 thereto. The pin 180 of the knob 164 extends through central openings 157, 159 in the upper and lower body halves 156, 158.

In a first or floor cleaning position of the knob 164, the valve member 160 blocks the second inlet 172. Counterclockwise rotation of the knob 164 rotates the valve member about the central axis of the pin 180 to a second or attachment cleaning position where the valve member 160 blocks the first inlet 170. The switch 166 is mounted to a top surface of the upper body halve 156. The cam 182 of the knob 164 depresses an actuator 188 of the switch 166 when the knob 164 is in the first position to activate the brush roll motor 108 and to deactivate the cleaning solution pump motor 142. The cam 182 of the knob 164 does not depress the actuator 188 of the switch 166 when the knob 164 is in the second position to deactivate the brush roll motor 108 and to activate the cleaning solution pump motor 142.

Integrally molded in the front end of the motor support 48 is a suction duct 190. The suction duct 190 has an upward facing rectangularly-shaped inlet 192 at the top of the motor support 48 and a rearward facing rectangularly-shaped outlet at the bottom of the motor support 48. The outlet 174 of the valve/switch assembly 154 is adapted to sealingly close the inlet of the suction duct 190. The suction duct 190 provides fluid communication between the valve/switch assembly 154 and the recovery tank assembly 34 as further described below.

Figure 4:
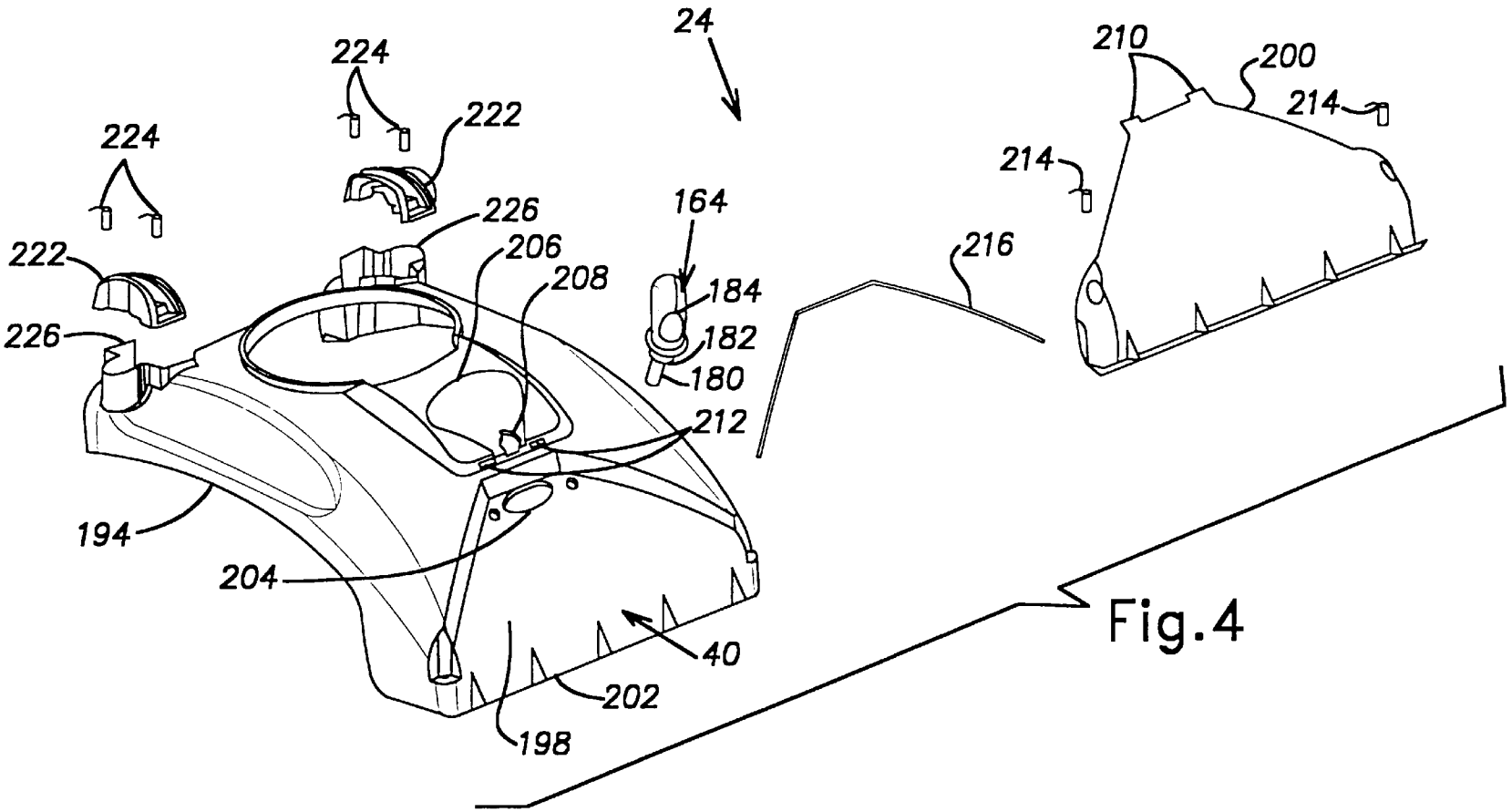
FIG. 4 is an exploded view of a hood assembly of FIG. 2.

As best shown in FIG. 4, the hood assembly 24 includes a hood 194 which is affixed to the base assembly 22 over the motor support 48. The hood 194 has a circular-shaped opening 196 throughwhich the motor/fan assembly 38 passes. The forward end of the hood 194 slopes downward and has a depressed zone 198 which in cooperation with a nozzle cover 200, forms the suction nozzle 40. The suction nozzle 40 has an elongated inlet slot 202 laterally extending the full width of the forward end of the hood assembly 24. The width of the suction nozzle 40 gradually decreases in the rearward direction and terminates at an elongate and generally downward facing outlet opening 204. The outlet opening 204 cooperates with the first inlet 170 of the valve/switch assembly 154 to provide fluid communication between the suction nozzle 40 and the valve/switch assembly 154. The gasket 162 of the valve/switch assembly 154 provides a fluid tight seal between the lower surface of the hood 194 and the upper surface of the valve/switch assembly 154.

The hood 194 also has a wedge-shaped depression 206 located between the depressed zone 198 and the motor/fan assembly opening 196. The depression 206 is sized and shaped for the handle 184 of the knob 164 and is adapted to allow rotation of the knob 164 between the first and second positions. An opening 208 is provided at the forward end of the depression 206 for passage of the knob 164 to the valve/switch assembly 154 therebelow.

The nozzle cover 200 is preferably affixed to the hood 194 by a pair of tabs 210 located at the rear end of the nozzle cover 200 which are received in cooperating slots 212 in the hood 194 and two screws 214 at the forward end of the nozzle cover 200 as illustrated. Extending around the perimeter of the depressed zone 198 is a groove which receives therein a rope seal 216. A peripheral flange of the nozzle cover 200 engages the rope seal 216 to provide an air-tight seal so that air enters the suction nozzle 40 only through the inlet slot 202.

Referring to FIGS. 2, 3, 4, and 10 the motor support 48 of the base assembly 22 at the rear end thereof has integrally molded journals 218 for rotatably receiving therein trunions 220 of the handle assembly 26. The trunions 220 are rotatably retained in place by trunion retainers 222 attached to the journals 218 by screws 224. The hood 194 is provided with openings 226, at the rear end thereof, which are formed to substantially enclose the journals 218 and trunions 220. Attached to the rear of the base assembly 22 is a handle assembly release pedal 228. The release pedal 228 is spring biased to lock the handle assembly 26 into an upright position. When the release pedal 228 is depressed to overcome the bias of the spring 230, the handle assembly 26 is free to rotate downwardly in a rearward direction about the trunions 220 mounted in the journals 218.

Figures 6, 7:
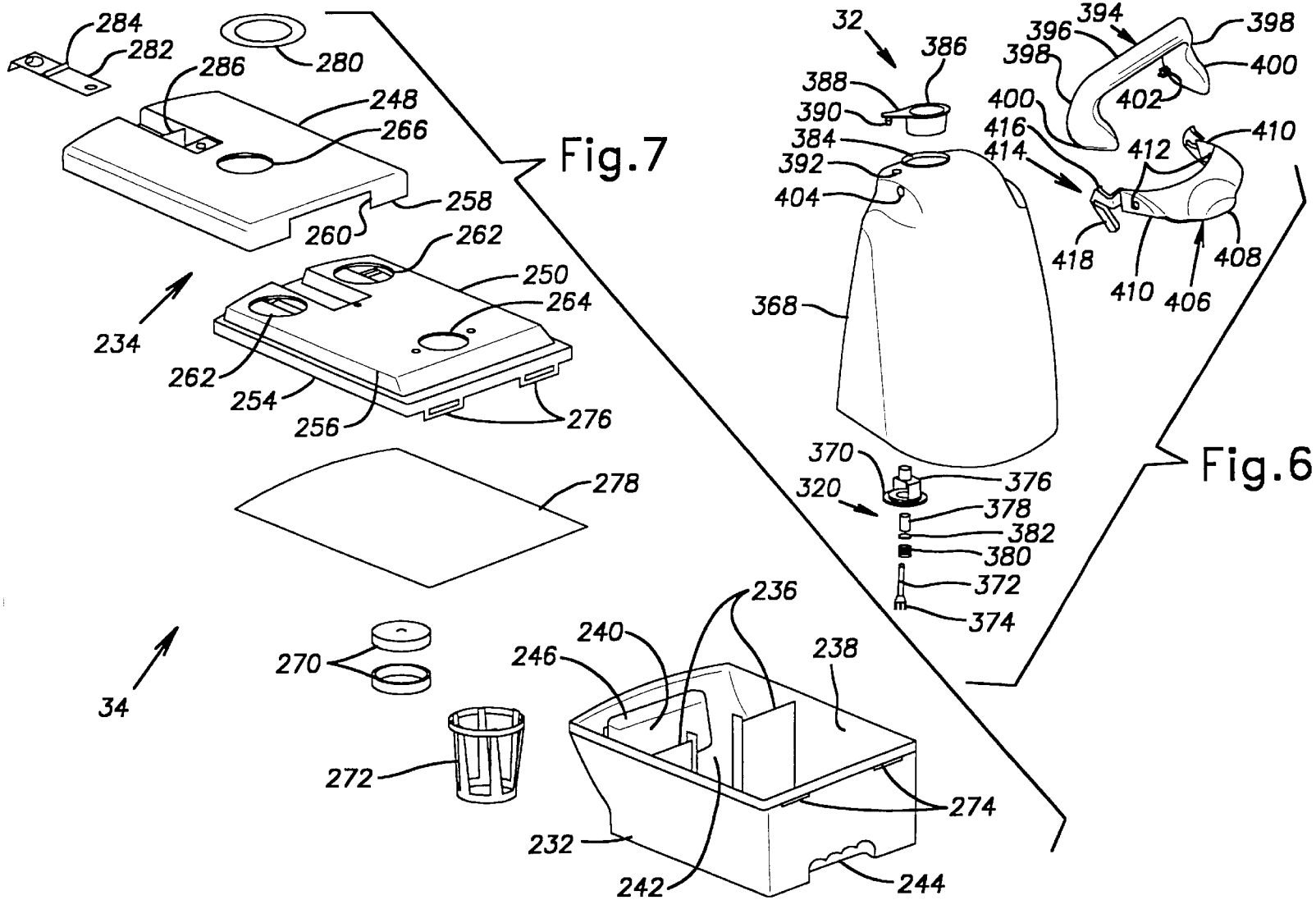
FIG. 6 is an exploded view of a handle assembly of FIG. 2.
FIG. 7 is an exploded view of a dispensing tank assembly of FIG. 2.

As best shown in FIG. 7, the recovery tank assembly 34 includes a rectangularly-shaped pan or tank 232 with an open top and a lid assembly 234 which closes the open top of the tank 232. Positioned inside the tank 232 are two vertical baffles 236 which act to limit the degree of fluid sloshing during the forward and reverse push-pull operation of the wet extractor 20 in the floor cleaning mode and assists in separation of liquid from working air by creating a turbulent flow. The baffles 236 are positioned near the rear end of the tank 232 and laterally extend from opposite sides of the tank 232 to form a forward interior chamber 238 and a rear interior chamber 240 with a central passage 242 therebetween. The baffles 236 are integrally molded with the floor and side walls of the tank extending upwardly and inwardly therefrom. Forward and rear hand grips 244, 246 are preferably molded in the front and rear walls of the tank 232 for carrying the recovery tank assembly 34 when the tank 232 is full of recovered cleaning fluid.

The lid assembly 234 includes a hollowed lid 248 and a bottom plate 250 which are sealingly welded together to form an inlet chamber 252 (FIG. 11*a*) therebetween. The bottom plate 250 includes a rim 254 which cooperates with the top edge of the tank 232 and a raised central portion 256 which forms a peripheral ledge to receive a rim 258 of the lid 248. The forward end of the rim 258 of the lid 248 is provided with a rectangularly-shaped inlet opening 260 which fluidly communicates the inlet chamber 252 with the outlet of the suction duct 190 of the base assembly 22. The forward edge of the raised central portion 256 of the bottom plate 250 preferably angles upwardly and rearwardly to direct fluid flowing through the inlet opening 260 into the inlet chamber 252. A pair of openings 262 are located on opposite sides of the rear end of the bottom plate 250 which fluidly communicate the inlet chamber 252 of the lid assembly 234 with the rear chamber 240 of the tank 232. The openings 262 are located laterally adjacent and to the rear of the baffles 236 such that there are two flow paths through the rear chamber 240 from the openings 262 to the central passage 242 which converge to form turbulent flow.

An outlet opening 264 is located in the forward end of the bottom plate 250 which cooperates with an outlet opening 266 in the center of the lid 248 to fluidly communicate the forward chamber 238 of the tank 232 with the suction inlet of the motor/fan assembly. The lid 248 includes an integrally molded rectangularly-shaped wall 268 (FIG. 11*a*) which extends about the periphery of the outlet openings 264, 266 to form a sealed passage between the outlet opening 264 in the bottom plate 250 and the outlet opening 266 in the lid 248. A two-piece float 270 is provided within a float cage 272 attached to the bottom plate 250 to choke the flow of working air through the outlet opening 264 in the bottom plate 250 when recovered cleaning fluid within the tank 232 reaches a desired level.

The lid assembly 234 is removably attached to the tank 232 by the engagement of a pair tangs 274 outwardly extending from the forward wall of the tank 232 and a pair of slotted tangs 276 downwardly extending from the forward rim of the bottom plate 250. Any suitable sealing means such as a rope seal 278 is be used to seal the lid assembly 234 to the tank 232. The rope seal 278, and any other rope seal identified herein, is preferably made from closed cell extruded cellular rubber.

The recovery tank assembly 34 is slidably received in the rearward facing cavity 50 formed between the base frame 46 and motor support 48 of the base assembly 22 such that the tank 232 rests on and is supported by the bottom wall of the base frame 46. In this position, the inlet opening 260 is sealingly in fluid communication with the inlet of the suction duct 190 of the motor support 48 and the outlet opening 266 is sealingly in fluid communication with the inlet air opening 62 of the motor support 48. The lid assembly 234 also includes a gasket member 280 to provide a seal at the interface between the lid 248 and the inlet air opening 62.

The recovery tank assembly 34 is releasably held within the cavity 50 of the base assembly 22 by a latch member 282. The latch member 282 has an upwardly extending protrusion 284 which engages an inner surface of the base assembly 22 to prevent rearward movement of the recovery tank assembly 34 relative to the base assembly 22. The forward end of the latch member 282 is attached to the lid 248 and is supported by a wall 286 of the lid located near the forward end of the latch member 282 in a cantilevered manner. The recovery tank assembly 34 is removed from the base assembly 22 by applying a downwardly directed force onto the rear end of the latch member 282 to downwardly deflect the latch member 282 about the wall 286 of the lid 248 so that the protrusion 284 is moved below the bottom edge of the inner surface of the base assembly 22. With the protrusion 284 below the bottom edge of the inner surface of the base assembly 22, the recovery tank assembly 34 can be pulled out of the cavity 50 in the base assembly 22. The recovery tank assembly 34 is reinserted into the base assembly 22 by forwardly pushing the recovery tank assembly 34 into the cavity 50. The latch member 282 is downwardly deflected as a forward facing camming surface of the protrusion 284 engages the wall of the base assembly 22. Once the protrusion 284 has passed to the forward side of the wall, the latch member 282 resiliently springs upward so that engagement between the protrusion 284 and the inner surface of the wall prevents removal of the recovery tank assembly 34 from the base assembly 22.

As best shown in FIGS. 11*a* and 11*b*, the recovery tank assembly 34 acts as both a liquid/gas separator and a storage tank for the liquid. A liquid/gas mixture, typically a mixture of water and air, is drawn through the inlet opening 260 of the recovery tank assembly 34 by suction of the motor/fan assembly 38. The mixture passes through the inlet chamber 252, between the lid 248 and the bottom plate 250, in two flow paths to the openings 262 in the bottom plate 250. The two flow paths of the mixture pass downward through the openings 262 into the rear chamber 240 of the tank 232 and converge to pass through the central passage 242 between the baffles 236 into the forward chamber 238 of the tank 232. The turbulence caused by the converging flows substantially separates the liquid from the gas. The liquid flows to the bottom of the tank 232 where it remains until the operator empties the tank 232. The gas flows upwardly through the outlet opening 264 in the bottom plate 250, rearwardly to the outlet opening 266 in the lid 248, and upwardly through the outlet opening 266 in the lid 248 to the inlet of the motor/fan assembly 38.

Figure 5:
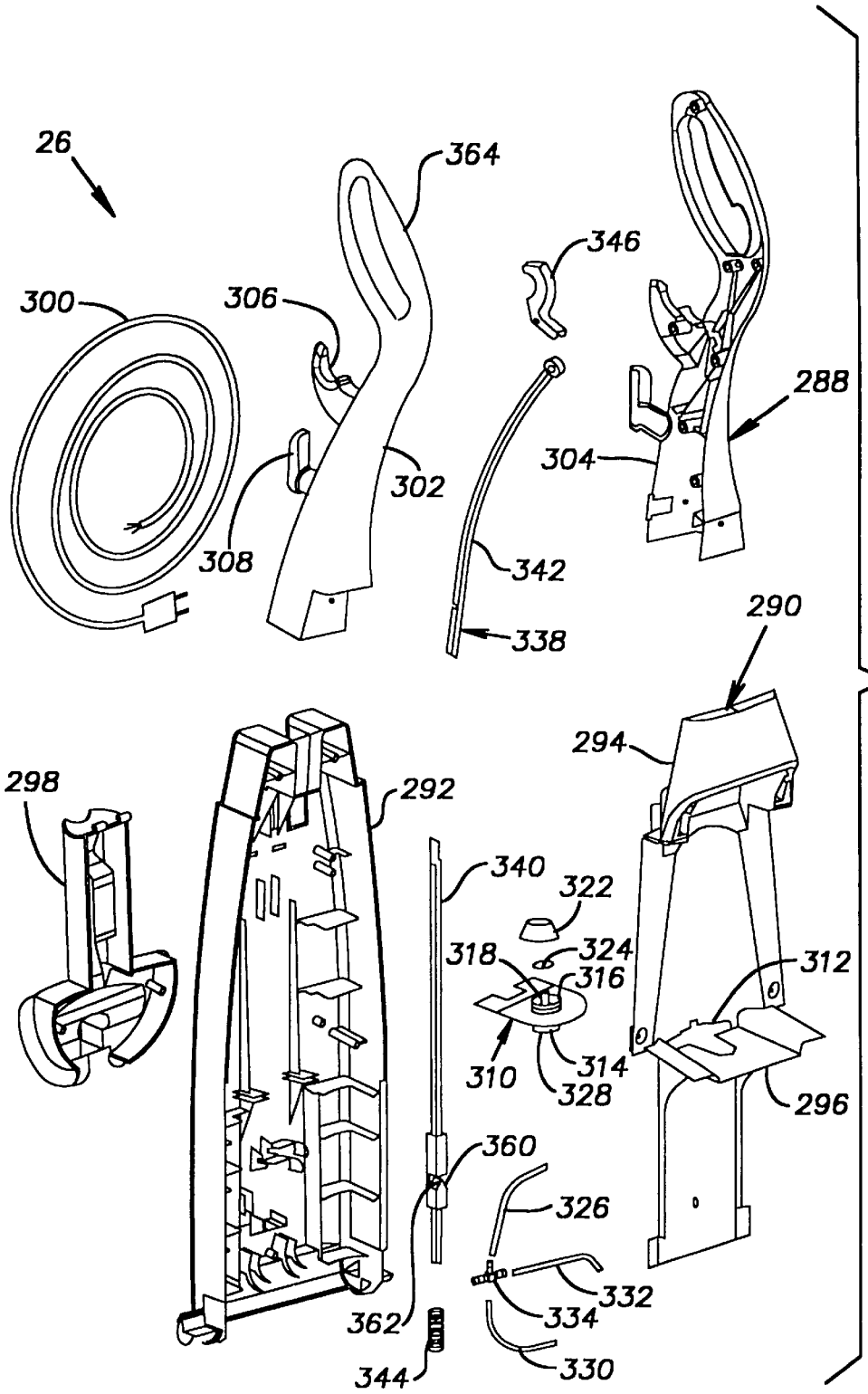
FIG. 5 is an exploded view of a recovery tank assembly of FIG. 2.

As best shown in FIG. 5, the handle assembly 26 includes an upper handle portion 288, and a lower handle portion 290. The lower handle portion 290 includes a generally hollow shell or body 292 with an open forward side and a face plate 294 which is attached to the body 292 to substantially close the forward open side of the body 292. Integrally molded in the face plate 294 is a forwardly extending support shelf 296. The lower handle portion 290 also includes an caddy 298 which is attached to the rear side of the body 292 for storing the attachment hose assembly 36 and a power cord 300 which extends into the body 292 to the base assembly 22 to supply power to electrical components.

The upper handle portion 288 includes right and left body halves 302, 304 which are attached together. The upper handle portion 288 telescopically cooperates with attachment posts of the lower handle portion 290 and is secured to the lower handle portion 290 with screws. Integrally molded in the upper handle portion 288 are rearwardly extending upper and lower arms 306, 308. The upper arm 306 is formed and located to cooperate with the caddy 298 for storage of the attachment hose assembly 36. The lower arm 308 is formed and located to cooperate with the caddy 298 for storage of the power cord 300.

Slidably received in the body 292 is a cleaning solution reservoir assembly 310 which receives and holds a quantity of cleaning solution from the dispensing tank assembly 32 for distribution to supply tubes as further described below.

The reservoir assembly protrudes through an aperture 312 in the face plate 294 aligning with the top surface of the support shelf 296 such that the top surface of the reservoir assembly 310 is generally planar with the top surface of the support shelf 296.

The reservoir assembly 310 includes a basin 314 having a reservoir volume which the dispensing tank assembly 32 floods with cleaning solution though an inlet port 312 located at a top of the basin 314. Extending axially upward through the inlet port 316 is a pin 318 which acts to open a supply valve 320 of the dispensing tank assembly 32 when the dispensing tank assembly 32 is on the support shelf 296 and secured in place. The reservoir assembly 310 also includes a frusto-conically shaped boot seal 322 to provide a seal between the reservoir assembly 310 and the dispensing tank assembly 32 and a filter screen 324 to filter cleaning solution entering the reservoir assembly 310. The structure and operation of the dispensing tank assembly 32 is further described below.

A supply tube 326 is connected to an outlet port 328 of the reservoir assembly 310 located at the bottom of the basin 314. The other end of the supply tube 326 is connected to a pair of supply tubes 330, 332 by a T-shaped connector 334. One supply tube 330 provides a direct supply of cleaning solution from the reservoir assembly 310 to the inlet of the attachment pump 140. The other supply tube 332 provides a controlled supply of cleaning solution from the reservoir assembly 310 to the discharge nozzle assembly 118. The supply tube 332 is connected by a straight connector 336 (FIG. 3) to the supply tube 128 which extends through the opening 130 in the motor support 48 and is connected to the inlet 126 of the liquid manifold 120 of the discharge nozzle assembly 118.

As best shown in FIG. 5, a push rod assembly 338 vertically extends through the handle assembly 26. The push rod assembly 338 includes a lower rod 340, an upper rod 342, a compression spring 344, and a trigger 346. The lower and upper rods 340, 342 are positioned within the handle assembly 26 by means of integrally molded spacers 348, 350, 352 (FIG. 12) dimensioned and located as necessary.

Figure 12:
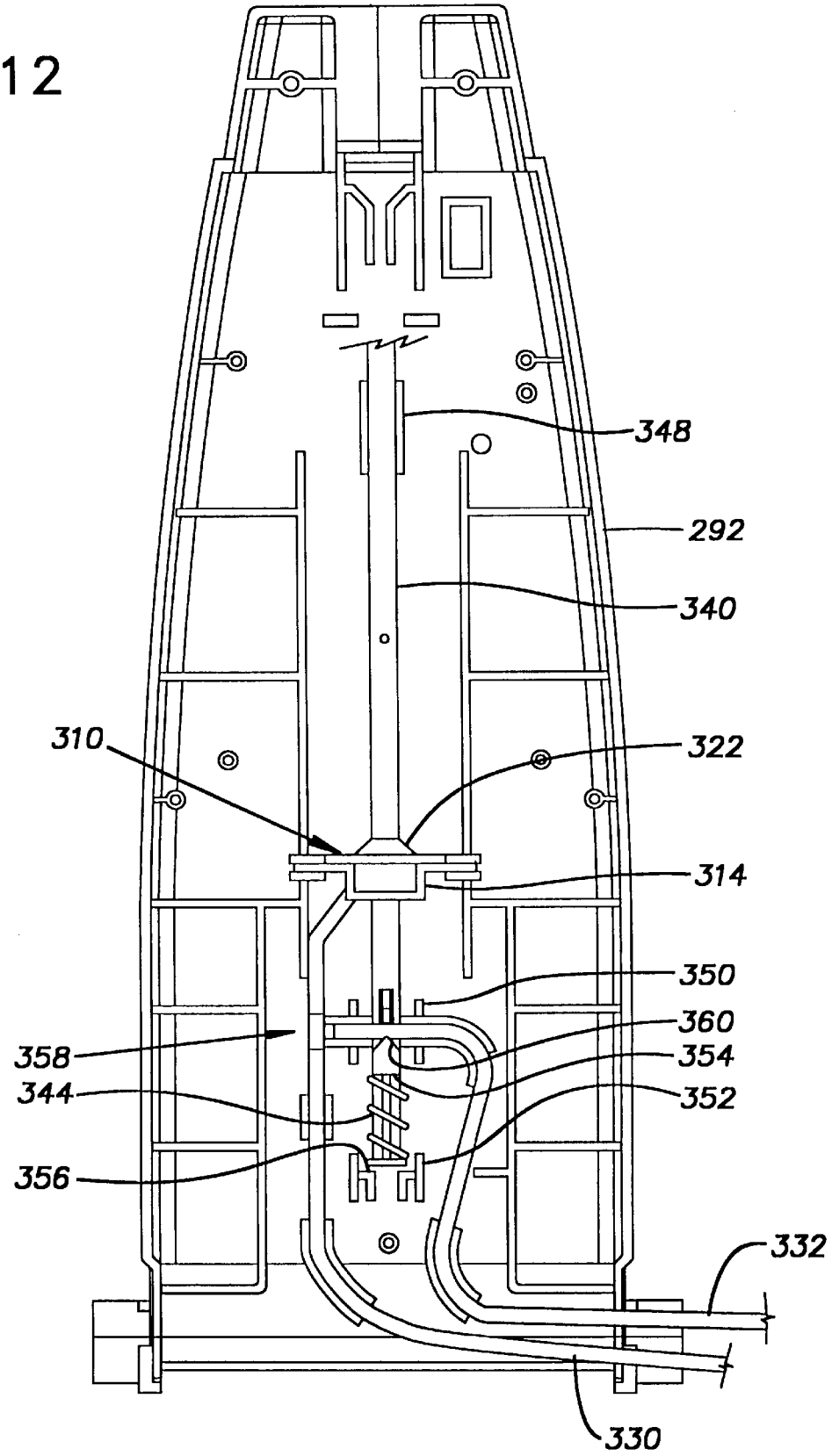
FIG. 12 is a front elevation view of a lower handle portion of the handle assembly of FIG. 5 with some components removed for clarity.

As best shown in FIG. 12, the spring 344 is located at the lower end of the lower rod 340 and engages a downward facing abutment 354 on the lower rod 340 near the lower end of the lower rod 340. The bottom pair of spacers 352 are sized for allowing the lower end of the lower rod 340 to translate downwardly therethrough while the spring 344 engages an upwardly facing abutment 356 of the spacers 352 which prevents passage of the spring 344 therethrough.

A pinch valve 358 selectively pinches and releases the supply tube 332 to control the flow of cleaning solution to the discharge nozzle assembly 118. The pinch valve 358 includes a horizontally extending groove 360 formed in the lower rod 340 which is sized for receiving the supply tube 332. The lower surface 362 of the groove 360 is inverted-V-shaped, that is, the height of the lower surface increases in each direction to a peak at the lateral center of the lower surface 362. The spacers 350 are provided at each side of the lower rod 340 adjacent the groove and engage both the top and bottom surfaces of the supply tube 332 adjacent the lower rod 340. The spacers 350 allow the lower rod 340 to vertically pass therebetween. Normally, the spring 344 upwardly urges the lower rod 340 to a closed position of the pinch valve 358 wherein the supply line 332 is pinched closed so that no cleaning solution passes therethrough.

Figure 13:
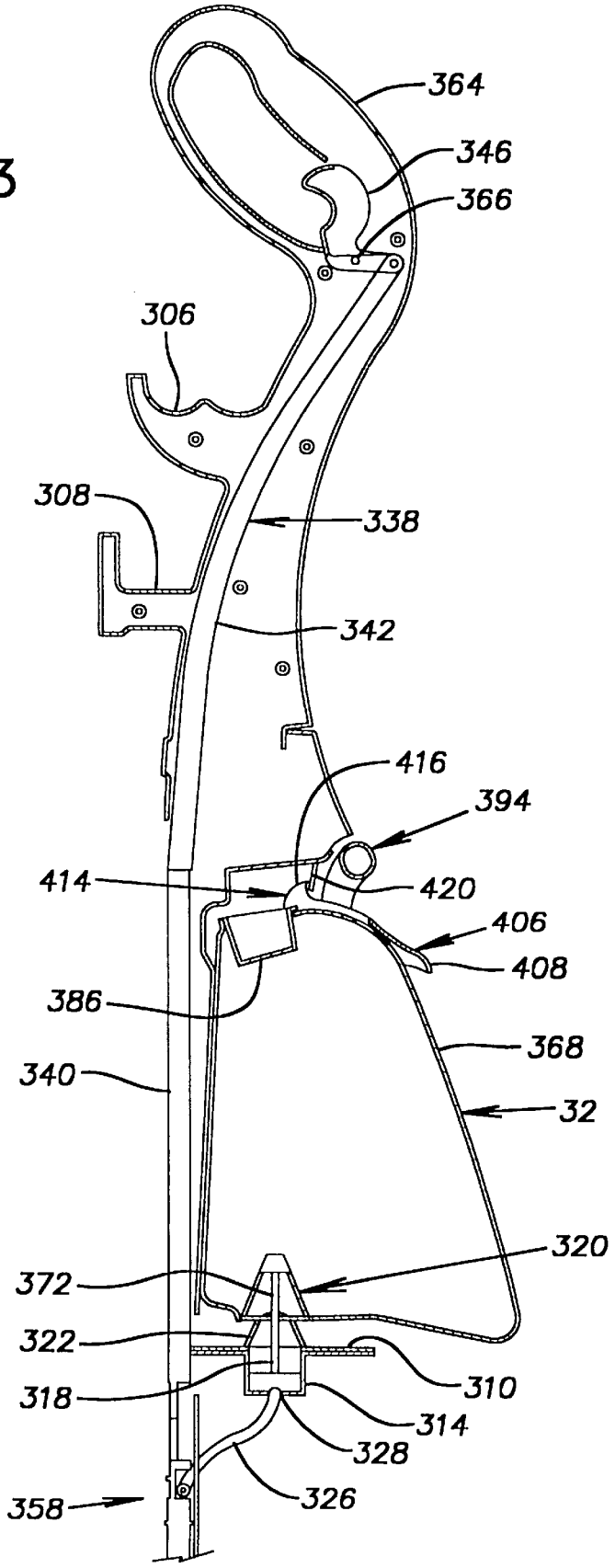
FIG. 13 is a side elevation view, in cross-section, of a portion of the handle assembly of FIG. 5 and the dispensing tank assembly of FIG. 6, with some components removed for clarity.

As best shown in FIG. 13, the upper end of the lower rod 340 engages the lower end of the upper rod 342. The top of the upper rod 342 is pivotally attached to the trigger 346 located at a hand grip 364 of the upper handle portion 288. The trigger 346 is pivotally attached to the upper handle portion 288 at a pivot 366 such that the upper rod 342 downwardly translates when the operator squeezes the trigger 346. The downward translation of the upper rod 342 downwardly translates or pushes the lower rod 340 to overcome the bias of the spring 344 and gradually open the pinch valve 358 to allow the flow of cleaning solution through the supply tube 332. When the trigger 346 is fully squeezed, the pinch valve 358 is in a fully open position wherein the supply tube 332 is generally unpinched, that is, completely open. Upon release of the trigger 346, energy stored in the spring 344 returns the pinch valve 358 to the closed position.

As best shown in FIG. 6, the cleaning solution dispensing tank 32 includes a hollow reservoir or tank 368. Incorporated into a bottom wall of the tank 368 is the supply or release valve 320 which includes a valve seat 370 and an elongate plunger 372 extending coaxially upward therethrough. The plunger 372 has an outside diameter less than the inside diameter of the valve seat 370 and is provided with at least three flutes 374 to maintain alignment of the plunger 372 within the valve seat 370 as the plunger 372 axially translates therein and permits the passage of cleaning solution therethrough when the plunger 372 is in an open position.

An open frame 376 is integrally molded atop the valve seat 370 with a vertically extending bore slidingly receiving an upper shank of the plunger 372. An elastomeric circumferential seal 378 encircles the plunger 372 to sealingly engage the valve seat 370. The seal 378 is downwardly urged into engagement with the valve seat 370 by action of a compression spring 380 which encircles the plunger 372 and is positioned between the frame 376 and the seal 378. A washer 382 is provided between the spring 380 and the seal 378.

When the dispensing tank assembly 32 is removed from the wet extractor 20, the release valve 320 is in a closed position wherein the seal 378 is urged into engagement with the valve seat 370 so that no cleaning solution can flow through the valve seat 370. When the dispensing tank assembly 32 is placed upon the support shelf 296 of the handle assembly 26, the release valve 320 is moved to an open position wherein the seal 378 is out of engagement with the valve seat 370 so that cleaning solution can flow through the valve seat 370 into the reservoir assembly 310. The pin 318 of the reservoir assembly 310 aligns with the plunger 372 and is received within the flutes 374 of the plunger 372 to force the plunger 372 upward to compress the spring 380 and open the valve seat 370. In the open position, cleaning solution flows from the tank 368 to the reservoir assembly 310. Upon removal of the dispensing tank assembly 32 from the support shelf 296, energy stored within the compression spring 380 returns the release valve 320 to the closed position.

An opening 384 is located at the top of the tank 368 through which the tank 368 can be filled with cleaning solution. A removable cap 386 closes the opening 384. The cap 386 is preferably provided with a tether 388 to removably attach the cap 386 to the tank 368. The tether 388 of the illustrated embodiment is attached to the tank 368 by a plug 390 which deforms during insertion through an opening 392 in the top of the tank 368 and resiliently expands once through the opening 392 to prevent the plug 390 from being unintentionally removed from the opening 392. Additionally, a check valve is preferably provided in the cap 386 to assure that pressure within the tank 368 remains substantially equal with atmospheric pressure, as cleaning solution is drawn from the tank 368.

The dispensing tank assembly 32 also includes a handle member 394 which provides a convenient means for carrying the dispensing tank assembly 32 when removed from the wet extractor 20. The handle member 394 has a generally horizontal bar portion 396, an integral leg portion 398 extending from each end of the bar portion 396, and an integral foot portion 400 forwardly extending from the bottom of each leg portion 398. The two leg portions 398 are generally parallel and are generally perpendicular to the bar portion 396. Each leg portion has an integral, cylindrically-shaped, horizontally extending, and inwardly facing pin 402. The pins 402 are rotatably received within a pair of cylindrically-shaped, horizontally extending, outwardly facing, and co-axial recesses 404 located in a top portion of the tank 368. With the handle member 394 attached to the tank 368 in this manner, the handle member 394 is rotatable relative to the tank 368 about the centerline of the pins 402.

The dispensing tank assembly 32 also includes a latch member 406 which provides a convenient means for releasably securing the tank 368 to the handle assembly 26. The latch member 406 is generally U-shaped having a front portion 408 and a pair of arm portions 410 which extend from opposite ends of the front portion 408 around the top portion of the tank 368. The arm portions 410 extend between the handle member 394 and the tank 368. The latch member 406 is pivotally secured to the tank 368 by a pair of openings 412 throughwhich the pins 402 of the handle member 394 extend. The rear end of each arm portion 410 is provided with latch means 414 which are adapted to coact with cooperating latch means on the handle assembly 26 to secure the tank 368 to handle assembly 26. The latch means 414 of the illustrated embodiment includes an upwardly extending protrusion 416 which has a forward facing locking surface and rear facing camming surface. An integrally molded spring arm 418 downwardly extends from the end of each arm portion 410 and engages a top surface of the tank 368 to preload the protrusion 416 into a raised or locked position wherein the protrusion 416 retains the tank 368 to the handle assembly 26 (best shown in FIG. 13).

When the dispensing tank assembly 32 is placed on the support shelf 296 of the handle assembly 26 the camming surface of the protrusion 416 engages and cams upon a lower edge of a wall 420 (FIG. 13) of the handle assembly 26 forcing the rear end of the latch member 406 downward until the protrusion 416 is past the wall 420. Once the protrusion 416 is past the wall 420, the spring arms 418 resiliently bias the protrusion 416 upward behind the wall 420 to secure the dispensing tank assembly 32 in place. When the dispensing tank assembly 32 is secured to the handle assembly 26, the handle member 394 of the dispensing tank assembly 32 is substantially locked in position to prevent rotation relative to the tank 368. The bar portion 396 and/or leg portions 398 engage the handle assembly 26 to prevent rearward rotation of the handle member 394 relative to the tank 368 and the foot portions 400 engage the top surface of the tank 368 to prevent forward rotation of the handle member 394 relative to the tank 368.

To remove the dispensing tank assembly 32 from the handle assembly 26, the operator grasps and raises the front portion 408 of the latch member 406 with enough force to overcome the pre-load or bias of the spring arms 418 and to downwardly pivot the latch member 406 to a lowered or unlocked position wherein the latch means 414 allows the tank 368 to be removed from the handle assembly 26. In the unlocked position, the protrusion 416 of the latch member 406 is below the lower edge of the wall 420 of the handle assembly 26 so that the dispensing tank assembly 32 can be removed from the handle assembly 26. When removed from the handle assembly 26, the dispensing tank assembly 32 is conveniently carried by the handle member 394 which rearwardly pivots relative to tank 368.

Figure 8:
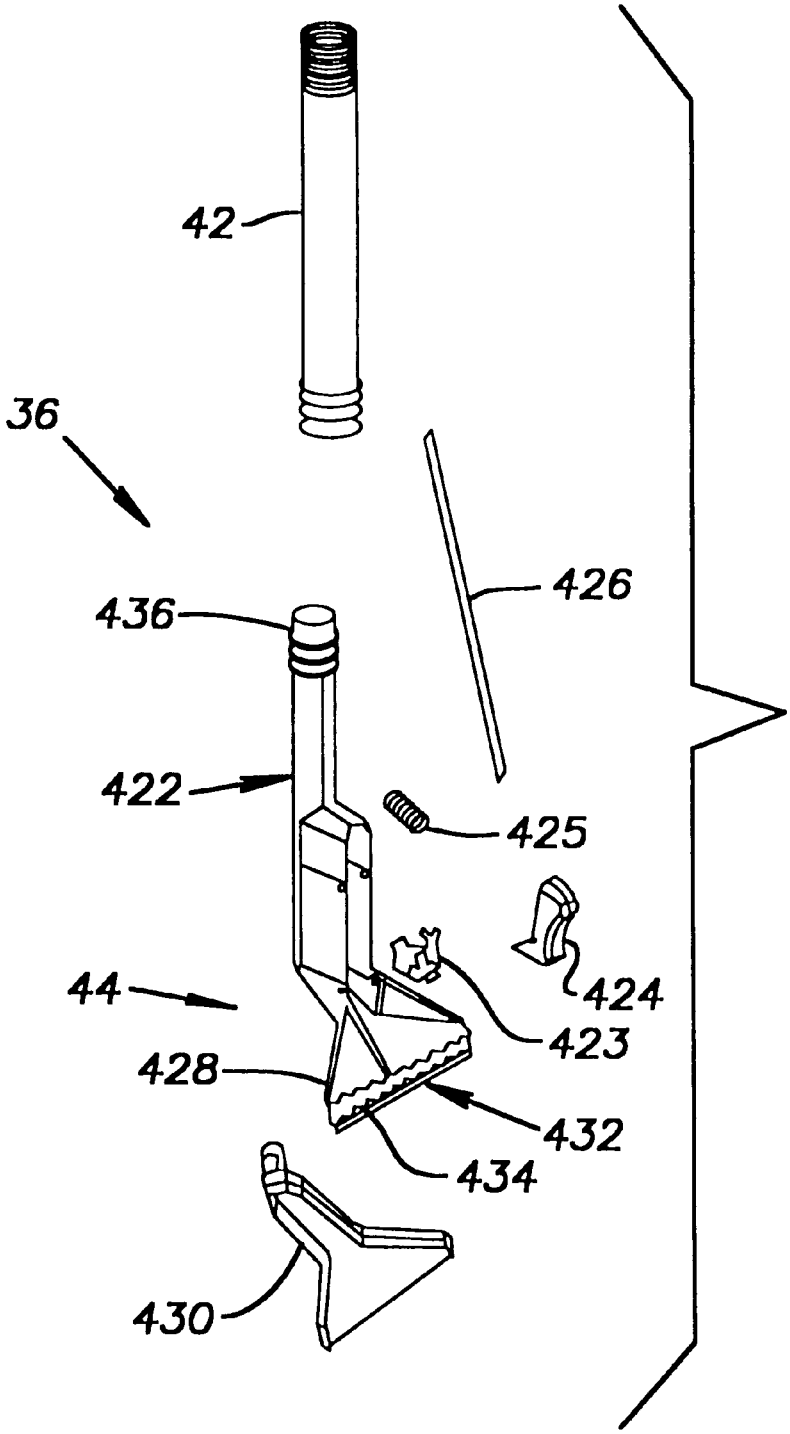
FIG. 8 is an exploded view of an attachment hose assembly of FIG. 2.

As best shown in FIG. 8, the onboard attachment hose assembly 36 includes the hand operated upholstery/stair cleaning nozzle assembly 422, the suction hose 42, a cleaning solution discharge or spray nozzle 423, an on/off trigger operated valve 424, a trigger spring 425, and a cleaning solution supply tube 426. The nozzle assembly 422 includes a main body 428 and a cover plate 430 which together form a suction nozzle 432 which has an elongated inlet slot 434 in fluid communication with a cylindrically shaped outlet 436 adapted for receiving the suction hose 42. One end of the suction hose 42 is connected to the suction nozzle outlet 436 while the other end of the suction hose 42 is connected to the second inlet 172 of the valve/switch assembly 154. The spray nozzle 423 is located adjacent the suction nozzle 432 for dispensing cleaning solution upon a surface to be cleaned. The on-off trigger operated valve 424 is provided to control the amount of solution dispensed from spray nozzle 423. The trigger spring 425 biases the valve 424 to a closed position whereby passage of cleaning solution to the spray nozzle 423 is blocked. The operator can selectively pull the trigger to open the valve 424 to allow passage of the cleaning solution to the spray nozzle 423. Pressurized cleaning solution is supplied to the trigger operated valve 424 by the supply tube 426 which has one end connected to the spray means. The supply tube 426 passes through the entire length of the suction hose 42 and sealingly passes through an opening 438 (FIG. 3) in the valve/switch assembly 154 at the second inlet 172 (best shown in FIG. 3). The other end of the supply tube 426 is connected to the outlet of the attachment cleaning solution pump 140.

In operation, the inlet of the motor/fan assembly 38, which is on fluid communication with the recovery tank assembly 34, creates a vacuum within the recovery tank 34. When the wet extractor 20 is operated in the floor cleaning mode the knob 164 is in the first position so that the brush roll motor 108 is operating and the attachment cleaning solution motor 142 is not operating. Additionally, the first opening 170 of the valve/switch assembly 154 is in fluid communication with the recovery tank assembly 34. Working air, including entrained fluids, is drawn into the floor suction nozzle 40, through the valve switch assembly 154, and into the recovery tank assembly 34. Within the recovery tank assembly 34, liquid is separated from air and is deposited in the tank 232 as described above. The air is drawn into the inlet of the motor/fan assembly 38. Warm, moist exhaust air from the motor/fan assembly 38 is discharged through the discharge nozzle assembly 118 toward the surface being cleaned. Cleaning solution, upon the operators command of pulling the trigger 346, flows by gravity from the cleaning solution dispensing tank assembly 32 to the reservoir assembly 310 through the supply valve 320, through the supply tubes 326,332, 128, and into the liquid manifold 120 positioned within the discharge nozzle assembly 118 whereby the cleaning fluid is atomizingly distributed by the discharged exhaust air and conveyed therewith to the surface being cleaned.

To convert the wet extractor 20 to the upholstery or attachment hose mode, the knob 164 is rotated counterclockwise to the second position so that the brush roll motor 108 is not operating and the attachment cleaning solution motor 142 is operating. Additionally, the second inlet 172 of the valve/switch assembly 154 is in fluid communication with the suction duct 192 so that the attachment hose suction nozzle 432 is in fluid communication with the recovery tank assembly 34. Working air, including entrained liquids is drawn through the attachment hose suction nozzle 432, through the suction hose 42, through the valve/switch assembly 154, through the suction duct 190, and into the recovery tank assembly 34. The recovery tank assembly 34 separates the air and liquid as described above. Exhaust air from the motor/fan assembly 38 continues to be discharged from the floor discharge nozzle assembly 118. However, the pinch valve 358 is closed thereby preventing the flow of cleaning solution through the supply tube 332 to the discharge nozzle assembly 118. Cleaning solution, upon the operators command of pulling the trigger operated valve 424, is supplied under pressure from the pump 140 to the spray nozzle 423 through the supply tube 426 whereby cleaning solution is discharged from the spray nozzle 423 to the surface to be cleaned. Cleaning solution is supplied by gravity from the cleaning solution dispensing tank assembly 32 to the reservoir assembly 310 through the supply valve 320, and from the reservoir assembly 310 to the pump 140 through the supply lines 326, 330. It is noted that the wet extractor 20 is conveniently converted from the floor cleaning mode to the attachment hose mode by simply rotating the knob 164 which diverts the flow of working air, deactivates the brush roll motor 108, and activates the attachment hose cleaning solution motor 142.

Although particular embodiments of the invention have been described in detail, it will be understood that the invention is not limited correspondingly in scope, but includes all changes and modifications coming within the spirit and terms of the claims appended hereto.

What is claimed is:

1. An upright wet extractor comprising:

a main body including a base frame;

a handle pivotally connected to said base frame;

a fluid recovery tank secured to one of said main body and said handle, said fluid recovery tank being adapted to contain a quantity of fluid;

a cleaning solution reservoir secured to one of said main body and said handle, said cleaning solution reservoir being adapted to hold a quantity of cleaning solution;

a suction fan attached to said main body and having an inlet;

a floor suction nozzle;

an above-floor suction nozzle;

a converter assembly for selectively connecting one of said floor suction nozzle and said above-floor suction nozzle with said inlet of said suction fan; and a hose connecting said above-floor suction nozzle to said converter assembly, wherein said hose remains connected when said floor suction nozzle is in communication with said inlet of said suction fan.

2. The upright wet extractor according to claim 1, wherein said handle includes means for storing said above-floor suction nozzle and said hose.

3. The upright wet extractor according to claim 1, further comprising a cleaning solution pump, a first cleaning solution conduit, and a second cleaning solution conduit, wherein said cleaning solution pump receives cleaning solution from said cleaning solution reservoir via said first cleaning solution conduit and is operable to supply cleaning solution to said above-floor suction nozzle via said second cleaning solution conduit.

4. The upright wet extractor according to claim 3, wherein said cleaning solution pump is only operable to supply cleaning solution to said above-floor suction nozzle when said converter assembly connects said above-floor suction nozzle to said suction fan inlet.

5. The upright wet extractor according to claim 4, further comprising a rotary cleaning brush unit, said brush unit being secured to said main body adjacent said floor suction nozzle.

6. The upright wet extractor according to claim 5, further comprising a third cleaning solution conduit, said third cleaning solution conduit being operable to supply cleaning solution from said cleaning solution reservoir to an area in the vicinity of said floor suction nozzle and said rotary cleaning brush unit.

7. The upright wet extractor according to claim 6, further comprising a normally closed valve for controlling flow through said third cleaning solution conduit, said valve being opened to permit gravity flow of cleaning solution through said third cleaning solution conduit.

8. The upright wet extractor according to claim 5, wherein said rotary brush unit is operable only when said converter assembly connects said floor suction nozzle to said suction fan inlet.

9. An upright wet extractor, comprising:

a housing;

a cleaning solution reservoir;

a fluid recovery tank;

a motor secured to said housing;

a brush unit secured to said housing and rotatable relative to said housing;

a floor suction nozzle defining a floor suction inlet;

a hand held suction tool defining a hand tool suction inlet;

a rotary member operable to selectively supply suction to one of said floor suction inlet and said hand tool suction inlet;

a pump in fluid communication with said cleaning solution reservoir and said hand held suction tool, said pump being operable to supply fluid to said hand held suction tool when suction is supplied to said hand tool suction inlet.

10. An upright wet extractor according to claim 9, further comprising a hose, said hose being permanently attached to said housing and fluidly connected to said rotary member, said hand held suction tool being secured to an end of said hose.

11. An upright wet extractor according to claim 10, further comprising a handle, said handle being adapted to receive said hand held suction tool and said hose for storage purposes.

12. An upright wet extractor according to claim 9, wherein said rotary member is movable between a first position and a second position, suction being supplied to said floor suction inlet, and cut off from said hand tool suction inlet, when said rotary member is in said first position, and suction being cut off from said floor suction inlet, and supplied to said hand tool suction inlet, when said rotary member is in said second position.

13. An upright wet extractor according to claim 12, wherein said pump is operable when said rotary member is in said second position and is inoperable when said rotary member is in said first position.

14. An upright wet extractor according to claim 9, wherein said brush unit is rotated when suction is supplied to said floor suction inlet and said brush unit is stationary when suction is supplied to said hand tool suction inlet.

15. An upright wet extractor according to claim 14, wherein said rotary member is movable between a first position and a second position, suction being supplied to said floor suction inlet, and cut off from said hand tool suction inlet, when said rotary member is in said first position, and suction being cut off from said floor suction inlet, and supplied to said hand tool suction inlet, when said rotary member is in said second position.

16. An upright wet extractor according to claim 15, wherein said brush unit is rotated when said rotary member is in said first position and is stationary when said rotary member is in said second position.

17. An upright wet extractor according to claim 16, further comprising a hose, said hose being permanently attached to said housing and fluidly connected to said rotary member, said hand held suction tool being secured to an end of said hose.

18. An upright wet extractor according to claim 17, further comprising a handle, said handle being adapted to receive said hand held suction tool and said hose for storage purposes.

19. An upright wet extractor according to claim 9, further comprising an external actuator operatively connected to said rotary member, said actuator being secured to an exterior of said housing and being readily available for user manipulation to selectively move said rotary member between a first position, wherein suction is supplied to said floor suction inlet, and a second position, wherein suction is supplied to said hand tool suction inlet.

20. An upright wet extractor according to claim 19, wherein said pump is operable when said rotary member is in said second position and is inoperable when said rotary member is in said first position.

21. An upright wet extractor according to claim 20, wherein said brush unit is rotated when said rotary member is in said first position and is stationary when said rotary member is in said second position.

22. An upright wet extractor according to claim 21, further comprising a hose, said hose being permanently attached to said housing and fluidly connected to said rotary member, said hand held suction tool being secured to an end of said hose.

23. An upright wet extractor comprising:

a main body;

a handle pivotally connected to said main body;

a fluid recovery tank secured to said main body, said fluid recovery tank being adapted to contain a quantity of fluid;

a cleaning solution reservoir secured to said handle, said cleaning solution reservoir being adapted to hold a quantity of cleaning solution;

a suction fan attached to said main body and having an inlet;

a floor suction nozzle;

an above-floor suction nozzle;

a connector disposed in said main body and movable between a first position wherein said suction fan inlet is in fluid communication with said floor suction nozzle and a second position wherein said suction fan inlet is in fluid communication with said above-floor suction nozzle; and a hose extending from said main body and defining at least a portion of a conduit which extends from said connector to said above-floor suction nozzle, wherein said hose remains attached to said main body when said floor suction nozzle is in communication with said inlet of said suction fan.

24. The upright wet extractor according to claim 23, further comprising a cleaning solution pump, a first cleaning solution conduit, and a second cleaning solution conduit, wherein said cleaning solution pump receives cleaning solution from said cleaning solution reservoir via said first cleaning solution conduit and supplies cleaning solution to said above-floor suction nozzle via said second cleaning solution conduit.

25. The upright wet extractor according to claim 24, wherein said cleaning solution pump supplies cleaning solution to said above-floor suction nozzle only when said connector is in said second position.

26. The upright wet extractor according to claim 25, further comprising a rotary cleaning brush unit and a third cleaning solution conduit, said brush unit being secured to said main body adjacent said floor suction nozzle, said third cleaning solution conduit being operable to supply cleaning solution from said cleaning solution reservoir to an area near said floor suction nozzle and said rotary cleaning brush unit, wherein said rotary brush unit is operable only when said floor suction nozzle is in fluid communication with said suction fan inlet.

27. The upright wet extractor according to claim 26, further comprising a normally closed valve for controlling flow through said third cleaning solution conduit, said valve being opened to permit gravity flow of cleaning solution through said third cleaning solution conduit.

28. The upright wet extractor according to claim 27, wherein said above-floor suction nozzle comprises a manual valve to control dispensing of cleaning solution therefrom.

29. An upright wet extractor, comprising:

a main body having a handle pivotally secured thereto, said handle supporting a cleaning solution reservoir, said cleaning solution reservoir being adapted to hold a quantity of cleaning solution, wherein said main body comprises:

a fluid recovery tank, said fluid recovery tank being adapted to contain a quantity of fluid;

a brush unit mounted for rotation relative to said housing;

a motor unit which is adapted to rotate said brush unit;

a fan including an inlet, said fan inlet being in fluid communication with said fluid recovery tank so as to generate a reduced pressure in said recovery tank and thereby draw fluid into said recovery tank;

a floor suction nozzle disposed relatively forward of said brush unit and defining a floor suction inlet;

a hand held cleaning tool including a hose and a hand held cleaning tool suction nozzle defining a hand held cleaning tool suction inlet, said hose being secured to said main body and being manually movable relative to said main body;

a first conduit extending from said floor suction nozzle toward said recovery tank;

a second conduit extending from said hand tool suction inlet toward said recovery tank; and, a rotary member movable between first and second positions, wherein when said rotary member is in said first position said fluid recovery tank is fluidly connected to said first conduit and, when said rotary member is in said second position, said fluid recovery tank is fluidly connected to said second conduit.

30. The upright wet extractor according to claim 29, wherein said main body further comprises a pump in fluid communication with said hand held cleaning tool and said cleaning solution reservoir.

31. The upright wet extractor according to claim 30, wherein said pump supplies cleaning fluid to said hand held cleaning tool only when said rotary member is in said second position.

32. The upright wet extractor according to claim 31, wherein said brush unit is rotated when said fluid recovery tank is in fluid communication with said floor suction nozzle and is stationary when said fluid recovery tank is in fluid communication with said hand held suction inlet.

33. The upright wet extractor according to claim 31, wherein said pump is inoperable when said rotary member is in said first position.

34. An upright wet extractor comprising a main body, a handle pivotally connected to said main body, a fluid recovery tank secured to said main body, a cleaning solution reservoir secured to said handle, a brush mounted to said main body and rotatable relative thereto, a motor disposed in said main body and operable to rotate said brush, a suction fan attached to said main body, said suction fan being in fluid communication with said recovery tank, a floor suction nozzle provided by said main body, and a hose extending from said main body and being manually movable relative to said main body, wherein suction forces created by said fan are selectively communicated to said floor suction nozzle or said hose to draw fluid into said fluid recovery tank from only one of said floor suction nozzle and said hose, in combination therewith, the improvement comprising:

said hose being attached to said main body and remaining attached to said main body while suction force is communicated to said floor suction nozzle.

35. The upright wet extractor according to claim 34, the improvement further comprising a cleaning solution pump disposed within said main body and operable to communicate cleaning solution from said cleaning solution reservoir to said hose when suction forces are communicated to said hose.

36. The upright wet extractor according to claim 34, wherein said hose is at least a portion of a hand held cleaning tool, the improvement further comprising a first conduit extending from said floor suction nozzle toward said recovery tank, and a second conduit extending from a hand held suction nozzle of said hand held cleaning tool toward said recovery tank.

37. The upright wet extractor according to claim 36, the improvement further comprising a rotary member movable between first and second positions, wherein when said rotary member is in said first position said fluid recovery tank is fluidly connected to said first conduit and, when said rotary member is in said second position, said fluid recovery tank is fluidly connected to said second conduit.

38. The upright wet extractor according to claim 37, the improvement further comprising a pump disposed within said main body and operable to communicate cleaning solution from said cleaning solution reservoir to said hand held cleaning tool when suction forces are communicated to said hand held cleaning tool.

39. The upright wet extractor according to claim 34, the improvement further comprising a cleaning solution pump, a first cleaning solution conduit, and a second cleaning solution conduit, wherein said cleaning solution pump receives cleaning solution from said cleaning solution reservoir via said first cleaning solution conduit and supplies cleaning solution to said hose via said second cleaning solution conduit.

* * * * *